US005463537A

United States Patent [19]

Trattner et al.

[11] Patent Number: 5,463,537

[45] Date of Patent: Oct. 31, 1995

[54] FLASHING LIGHT DEVICE

[76] Inventors: Burton C. Trattner, 281 E. Skyline Lakes Dr., Ringwood, N.J. 07456; Wes LeMarr, 79 Hobart Ave., Rutherford, N.J. 07070

[21] Appl. No.: 282,632

[22] Filed: Jul. 29, 1994

[51] Int. Cl.[6] ..... F21L 15/14

[52] U.S. Cl. ..... 362/103; 362/806; 362/802; 362/276; 362/394; 36/137; 200/61.51; 200/61.52

[58] Field of Search ..... 362/394, 800, 362/396, 103, 276, 802; 36/137; 273/58 C; 200/61.51, 61.52, 61.48

[56] References Cited

U.S. PATENT DOCUMENTS 2,572,760 10/1951 Rikelman ..... 36/137
4,324,054 4/1982 Rovinsky ..... 36/137
4,412,205 10/1983 Von Kemenczky ..... 362/103 X
5,371,662 12/1994 Shen-Ko ..... 362/103 X

*Primary Examiner*—Ira S. Lazarus
*Assistant Examiner*—Thomas M. Sember
*Attorney, Agent, or Firm*—Alfred C. Hill

[57] ABSTRACT

A device capable of flashing upon movement of the device comprising at least one light emitting diode having a first preformed conductor connected to a cathode of the diode and a second preformed conductor connected to an anode of the diode; a first arrangement to provide a power source having a positive terminal and a negative terminal, the negative terminal being connected to the first conductor; a normally open contact lever coupled to the positive terminal capable of closing a connection to the second conductor resulting in light being emitted from the diode; and a second arrangement associated with the lever responsive to movement of the device to cause intermittent closing of the connection to the second conductor resulting in the diode flashing.

20 Claims, 3 Drawing Sheets

1
2
3
4
5
6
8
9
10
11
13
14
15
16
17
18
19
20
21
22
23
24
25
26
27
28

1
2
3
4
5
5'
6
8
9
10
11
13
14
15
16
17
23
24
26
27
28
29
30
37

FLASHING LIGHT DEVICE

BACKGROUND OF THE INVENTION

The present invention relates to a decorative device and more particularly to a flashing light device.

There is at present on the market shoes of the sneaker type that incorporate as an integral part thereof in the heel of the shoes a flashing light device that flashes when the wearer of the shoes walks and, in particular, runs. These shoes having the flashing light device in the heel thereof have become a status symbol among the teens and young adults and are very expensive. In addition, certain environmental groups have requested that these type of shoes be removed from the marketplace due to the fact that they incorporate in the mechanism a mercury switch. The reasoning of the environmental groups are that when these shoes are discarded and end up in the landfill or incinerator, the mercury in the mercury switches will contaminate the ground in the landfill and possibly the ground water and the air upon incineration.

To overcome the objections of the environmental groups, the manufacturer of the shoes incorporating the flashing light devices have changed from a mercury switch to a nonmercury switch to thereby eliminate the hazard of the mercury switch.

It is also known that in normal circuits employing a switch it is very desirable to prevent contact bounce when the switch is closed.

SUMMARY OF THE INVENTION

An object of the present invention is to provide a flashing light device that maximizes contact bounce in the mechanism providing the flashing light.

Another object of the present invention is to provide a flashing light device that incorporates a switching mechanism therein that is not hazardous to the environment.

A further object of the present invention is to provide a flashing light device which is sold as an accessory unit and does not require the purchase of a shoe.

Still another object of the present invention is to provide a flashing light device that may be clipped to apparel of the person employing the device, such as a shoe or shoes, a shirt, blouse or belt, or as a hair ornament for the person employing the device.

Still a further object of the present invention is to provide a flashing light device that may be employed other than on apparel of a person, such as point of purchase displays and any other device which needs to sense the presence of the slightest motion.

A feature of the present invention is the provision of a device capable of flashing upon movement of the device comprising at least one light emitting diode (LED) having a first preformed conductor connected to a cathode of the diode and a second preformed conductor connected to an anode of the diode; first means to provide a power source having a positive terminal and a negative terminal, the negative terminal being connected to the first conductor; a normally open contact lever coupled to the positive terminal capable of closing a connection to the second conductor resulting in light being emitted from the diode; and second means associated with the lever responsive to movement of the device to cause intermittent closing of the connection to the second conductor resulting in the diode flashing.

BRIEF DESCRIPTION OF THE DRAWING

Above-mentioned and other features and objects of the present invention will become more apparent by reference to the following description taken in conjunction with the accompanying drawing, in which.

DESCRIPTION OF THE PREFERRED EMBODIMENTS

Figure 1:
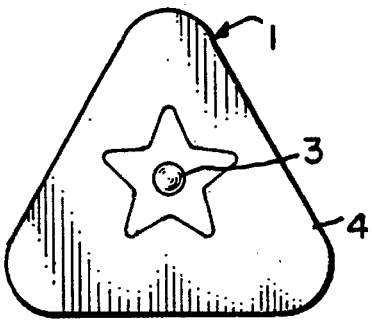
FIG. 1 is a front view of the flashing light device in accordance with the principles of the present invention.
Figure 2:
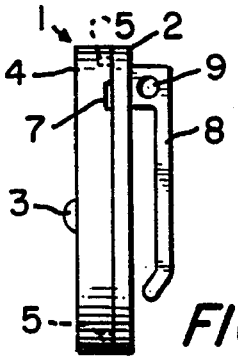
FIG. 2 is a side view of the flashing light device in accordance with the principles of the present invention.
Figure 3:
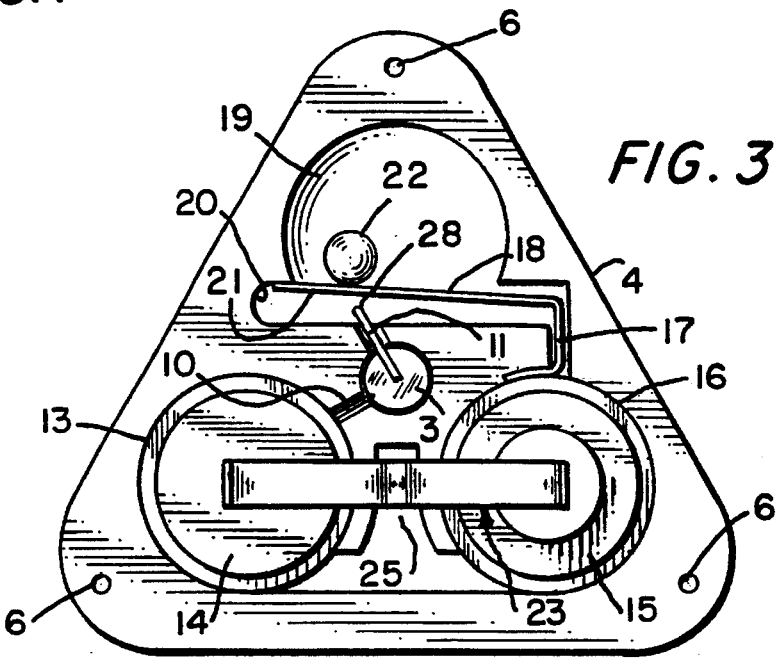
FIG. 3 is a view of the flashing light device with the cover removed showing the components of one embodiment of the flashing light device in accordance with the principles of the present invention.
Figure 6:
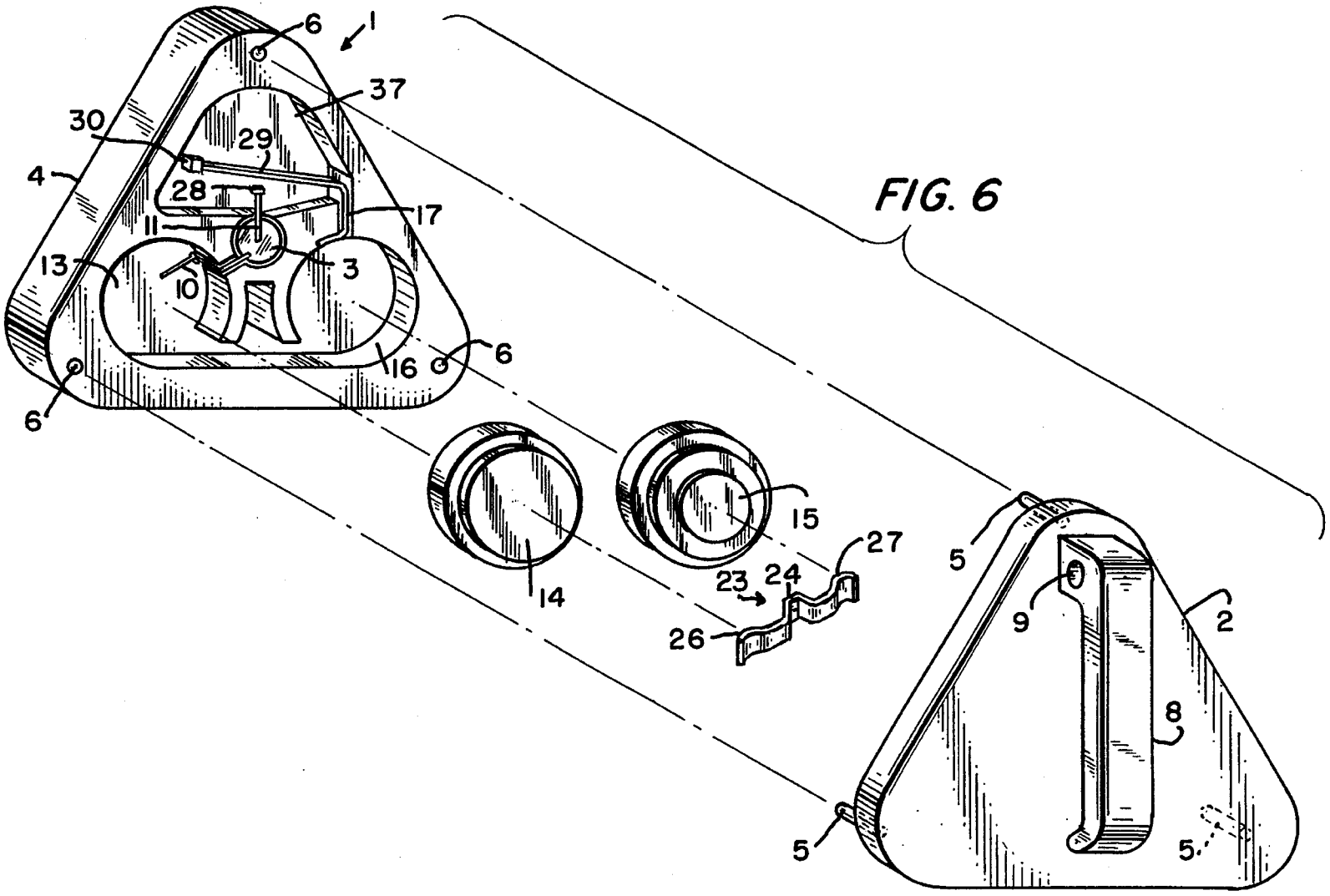
FIG. 6 is an exploded view of a second embodiment of the flashing light device in accordance with the principles of the present invention.

Referring to FIGS. 1 and 2, there is illustrated therein the flashing light device in accordance with the principles of the present invention including a case 1 having a removable cover 2 with a LED 3 protruding from the front surface of case 1 which is caused to flash upon movement of the flashing light device in the manner explained here inafter. The front of the case 1 surrounding the LED 3 has a predetermined design thereon which in FIG. 1 is shown to be a star. Any other decorative design could be used. Cover 2 is removably secured to the main body 4 of case 1 by projections 5 extending from cover 2 and having a snap-in fit in apertures 6 of main body 4 as illustrated in FIG. 3. Cover 2 can be removed from the main body 4 of case 1 by inserting a knife blade or a small screwdriver in the indentation 7 and twisting the same to release the projections 5 from the holes 6 carefully proceeding around the edge of the cover as the cover 2 moves away from the body 4 so as not to break off the projections 5. A second purpose of indentation 7, at least in the more sensitive embodiment of FIG. 6, is to enable a plastic strip to be passed into body 4 and be disposed therein to prevent contact at the switch point during shipping to the point of sale.

Alternatively, cover 2 could be permanently secured to body 4 by an appropriate securing device, such as a glue.

The cover 2 has a clip mechanism 8 formed thereon to enable the flashing light device to be secured to the laces or side of a shoe, any shoe, such as a sneaker or dress shoe. In the embodiment shown in FIG. 6 the clip 8 also enables a very sensitive version of the flashing light device to be fastened to the shirt, blouse or the belt of the person using the device. The clip 8 includes therein a hole 9 extending through clip 8 parallel to the surface of cover 2 to enable shoes laces, or other string-type implements to be passed therethrough to more securely fasten the flashing light device to the apparel of the person using the device.

Figure 4:
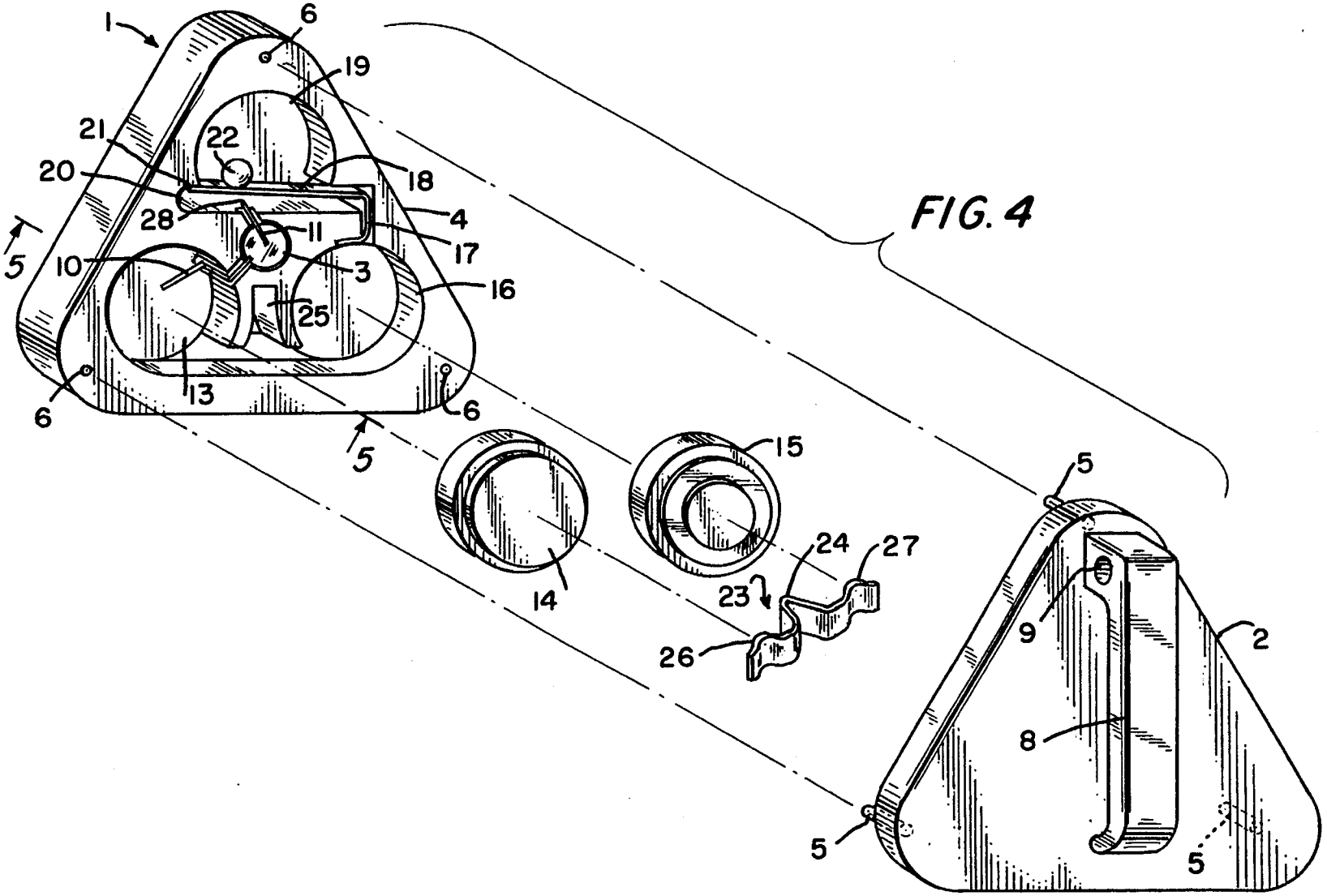
FIG. 4 is an exploded view of the embodiment illustrated in FIG. 3.

Referring to FIGS. 3 and 4, one of the embodiments of the flashing light device in accordance with the principles of the present invention is shown as including the LED 3 having a first preformed conductor 10 connected to the cathode of LED 3 and a second preformed conductor 11 connected to the anode of the LED 3.

Figure 5:
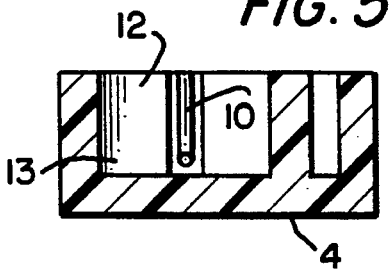
FIG. 5 is a cross-sectional view taken along line 5—5 of FIG. 4.

As shown in FIG. 5, preformed conductor 10 is preformed to run down a slot 12 adjacent the wall of cavity 13 to a point just above the bottom of cavity 13 and then bent to extend out into the space of cavity 13.

The power supply for the flashing light device of the present invention is provided by a pair of watch-type batteries 14 and 15. Battery 14 is oriented and dropped into cavity 13 so that the negative terminal thereof makes a solderless contact with conductor 10. Battery 15 is oriented so that when it is dropped into cavity 16 the positive terminal of battery 15 makes a solderless contact with a conductor 17 which is an extension of a normally open contact lever 18.

A partially circular chamber 19 is provided in body 4 with a slot 20 being provided across a portion of the partially circular chamber 19 into which the lever 18 is positioned. The edge 21 between chamber 19 and slot 20 limits the upper motion of lever 18 which is biased away from conductor 11 and, hence, the spring tension of lever 18 is preloaded in the upward direction away from the contact provided by conductor 11. A spherical object, such as steel ball 22, is disposed in chamber 19 and is free to move therein upon motion of the device. Ball 22 bounces in chamber 19 on lever 18 due to the motion of the device causing lever 18 to make contact intermittently with conductor 11 thereby intermittently lighting diode 3 to thereby cause LED 3 to flash.

The ball 22 is contained in a partially circular chamber 19 to increase the tolerance of directional sensitivity. Due to the partially circular chamber 19 there is a circumferential whipping and, therefore, acceleration of ball 22 in the partially circular chamber 19 for more switching activity inside the circle. This increases the amount of switch closures within each activating motion for a more desirable effect. It would be undesirable to provide a vertical cylinder for holding the ball 22, since the directional sensitivity and frequency of switching occurrences would be diminished in such an instance.

Careful selection of the spring characteristics of lever 18 so that the combination of the spring tension of lever 18, weight of ball 22 and proximity of the stationary leg or conductor 11 (the switching point) has been made to achieve the desired switching action. As mentioned above the moving lever 18 is preloaded in the upward direction away from conductor 11 where it rests and is limited by edge 21 where it remains trapped except for the slight downward travel which occurs when ball 22 bounces on lever 18 which then makes the momentary switch contact. This action furthers the quantity of flashes during walking or running.

To complete the connection between the batteries 14 and 15 to provide the power supply of the flashing light device of the present invention and also to insure the solderless connection between conductor 10 and the negative terminal of battery 14, a spring member 23 is provided having a preformed shape including a portion 24 which engages slot 25 in body 4 and preformed arms 26 and 27 having a configuration similar to that illustrated in FIG. 4, namely, a V-shape. When the spring member 23 is positioned so that portion 24 fits in slot 25, the arms 26 and 27 make electrical contact with the batteries 14 and 15 and when the cover 2 is placed in position on body 4 and snapped closed the spring tension in member 23 provides a positive solderless connection between the negative terminal of battery 14 and the conductor 10.

In order to extend the contact life of conductor 11 and lever 18 a special lubricant grease 28 is applied on the contact area of conductor 11 to minimize contact burning, metal transfer and oxidation. It is important to the present invention to keep the parts count, labor of assembly and, therefore, the cost of the flashing light device of the present invention to a minimum. This is accomplished in the present invention by having no wiring or soldering connections as described hereinabove.

A diffused LED is employed herein as opposed to a clear LED. The frosted or diffused lens of the diffused type of LED traps some of the light energy inside which makes the case glow. Use of this type of LED allows visibility from a wider angle of view and also appears brighter because the light energy is not projected within a narrow angle into space, as the case would be with a clear transparent projecting type LED. This was done to increase the visibility if used by runners at night, as well as enhancing the more dramatic effect for dancers or children playing in the street.

It will be obvious the combination of the components of the flashing light device in accordance with the principles of the present invention when attached to a shoe or sneaker at the laces or the side of the shoe to be the first battery operated flashing and illuminating device attached as an accessory to such shoe. Furthermore, when attached to the laces, the light faces forward in the direction in which a night time runner or walker should be heading as opposed to illumination at the heel of a shoe as in the prior art which does not face the oncoming traffic.

The embodiment of the flashing light device in accordance with the principles of the present invention illustrated in FIG. 6 includes the same components as illustrated in FIGS. 3 and 4 with the exception of the manner in which the intermittent contact to the LED 3 is made.

The lever 18 is replaced by a lever 29 which is calibrated to achieve the proper spring rate and the metal ball 22 is no longer used. Rather permanently secured to the far end of the lever 29 is a weight 30. The upper stop at lip 21 is also eliminated so that the spring arm 29 and the weight 30 can float in free suspension in the chamber 31. This weighted arm is preloaded slightly away from conductor 11. The slightest motion sets the end of lever 29 into a state of "quivering" and if the range of quiver reaches the conductor 11 a switch closure occurs resulting in an LED flash. The LED conductor 11 serves not only as a direct contact, but also as a bendable fulcrum so that the weight 30 actually goes beyond conductor 11 and the lever 29 bends and then springs back to increase the oscillations of future flashes. This enhances the sensitivity occurring without any addition to the parts count or complexity of the unit. Lever 29 makes contact with conductor 11 at approximately its midpoint to achieve the above.

This delicate motion sensing switch can also be employed in other electronic devices outside the product described herein and could also be of value in latching up burglar alarms, voice sound chips for toys, point of purchase displays or any other device which needs to sense the presence of the slightest motion.

Figure 7:
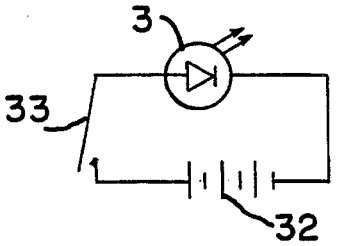
FIG. 7 is a circuit diagram of both the first and second embodiments of the flashing light device in accordance with the principles of the present invention.

Referring to FIG. 7, the electric circuit of the embodiments described hereinabove include an LED 3, a power supply 32 and the motion sensitive switch 33.

Figure 8:
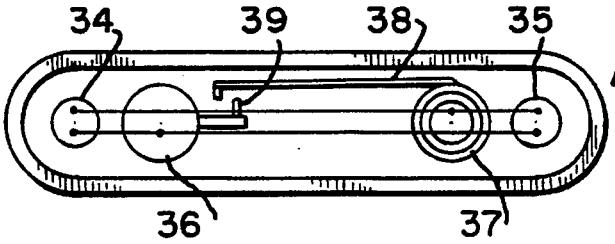
FIG. 8 is a top view of a third embodiment of the flashing light device in accordance with the principles of the present invention.

Referring to FIG. 8, there is illustrated therein a light flashing device incorporating a plurality of LEDs 34 and 35 with its power supply including the watch-type batteries 36 and 37 connected to the LEDs 34 and 35 as illustrated and the movable lever 38 and its contact 39 connected to the negative terminal of battery 36. With lever arm 38 being connected to the positive terminal of battery 37.

Although FIG. 8 discloses only two LEDs it is possible to provide a flashing light device in accordance with the principles of the present invention employing any number of LEDs provided the power supply is sufficient to operate the LEDs.

While we have described above the principles of our invention in connection with specific apparatus, it is to be clearly understood that this description is made only by way of example and not as a limitation to the scope of our invention as set forth in the objects thereof and in the accompanying claims.

We claim:

1. A device capable of flashing upon movement of said device comprising:

at least one light emitting diode having a first preformed conductor connected to a cathode of said diode and a second preformed conductor connected to an anode of said diode;

first means to provide a power source having a positive terminal and a negative terminal, said negative terminal being connected to said first conductor;

a normally open contact lever having a predetermined spring characteristic and one end thereof coupled to said positive terminal capable of closing a connection to said second conductor adjacent a point on said lever spaced from the other end of said lever resulting in light being emitted from said diode, said lever having a predetermined proximity to said second conductor when at rest; and second means having a predetermined weight associated with said lever responsive to movement of said device to cause intermittant closing of of said connection to said second conductor resulting in said diode flashing;

said predetermined spring characteristic, said predetermined weight and said predetermined proximity all being selected to provide a desired increase in switching activity and, hence, a desired increase in flashing when said lever bounces on said second conductor in response of said second means in response to movement of said device.

2. A device capable of flashing upon movement of said device comprising:

at least one light emitting diode having a first preformed conductor connected to a cathode of said diode and a second preformed conductor connected to an anode of said diode;

first means to provide a power source having a positive terminal and a negative terminal, said negative terminal being connected to said first conductor;

a normally open contact lever coupled to said positive terminal capable of closing a connection to said second conductor resulting in light being emitted from said diode;

second means associated with said lever responsive to movement of said device to cause intermittant closing of said connection to said second conductor resulting in said diode flashing;

a case having a cover containing said diode, said first means, said lever and said second means, said diode being disposed therein to shine from a surface of said case opposite said cover; and said first means includes a third means associated with said first means and said cover to cause a mechanical pressure on a portion of said first means to provide a solderless connection between said negative terminal and said first conductor.

3. A device according to claim 2, further including a lubricant grease disposed on said second conductor to minimize contact burning, metal transfer and oxidation to extend contact life of said second conductor and said lever.

4. A device according to claim 2, wherein said diode is a high bright, diffused light emitting diode to increase visibility of said flashing.

5. A device according to claim 2, wherein said cover includes a clip to enable clipping said device to apparel for a person using said device.

6. A device according to claim 5, wherein said clip includes a hole extending therethrough parallel to said cover to enable tying said device to said apparel.

7. A device according to claim 2, wherein said first means includes a pair of watch-type batteries; and said third means includes a spring strip having a predetermined configuration to interconnect said pair of batteries in series and to apply said mechanical pressure on one of said pair of batteries.

8. A device according to claim 2, wherein said case includes a chamber having a partially circular configuration, and a slot extending across the bottom of said chamber;

said second conductor and said lever being disposed in said slot, said lever being biased away from said second conductor and limited in movement away from said second conductor by an edge of said slot adjacent said chamber; and said second means includes a spherical object contained in said chamber capable of bouncing on said lever due to motion of said device to intermittently close said connection to said second conductor to provide said flashing.

9. A device according to claim 8, wherein said spherical object is a steel ball.

10. A device according to claim 8, further including a lubricant grease disposed on said second conductor to minimize contact burning, metal transfer and oxidation to extend contact life of said second conductor and said lever.

11. A device according to claim 8, wherein said diode is a high bright, diffused light emitting diode to increase visibility of said flashing.

12. A device according to claim 8, wherein said cover includes a clip to enable clipping said device to a shoe for a person using said device.

13. A device according to claim 12, wherein said clip includes a hole extending therethrough parallel to said cover to enable tying said device to said shoe.

14. A device according to claim 8, wherein said first means includes a pair of watch-type batteries; and said third means includes a spring strip having a predetermined configuration to interconnect said pair of batteries in series and to apply said mechanical pressure on one of said pair of batteries.

15. A device according to claim 2, wherein said case includes a chamber therein of predetermined configuration;

said second conductor and said lever being disposed in said chamber in a predetermined relationship; and said second means includes a weight having a predetermined value secured to a free end of said lever, said lever being set into a state of quivering due to the slightest motion of said device to intermittently close said connection to said second conductor to provide said flashing.

16. A device according to claim 15, further including a lubricant grease disposed on said second conductor to minimize contact burning, metal transfer and oxidation to extend contact life of said second conductor and said lever.

17. A device according to claim 15, wherein said diode is a high bright, diffused light emitting diode to increase visibility of said flashing.

18. A device according to claim 15, wherein said cover includes a clip to enable clipping said device to a selected one of a shirt, a blouse and a belt for a person using said device.

19. A device according to claim 15, wherein said first means includes a pair of watch-type batteries; and said third means includes a spring strip having a predetermined configuration to interconnect said pair of batteries in series and to apply said mechanical pressure on one of said pair of batteries.

20. A device according to claim further 15, wherein said device further includes a plurality of light emitting diodes coupled said first means, said lever and said second means to cause flashing of said plurality of diodes upon movement of said device.

* * * * *